US011688566B2

(12) United States Patent
Dognini et al.

(10) Patent No.: US 11,688,566 B2
(45) Date of Patent: Jun. 27, 2023

(54) SWITCHING APPARATUS FOR ELECTRIC SYSTEMS

(71) Applicant: ABB Schweiz AG, Baden (CH)

(72) Inventors: Ilaria Dognini, Caravaggio (IT); Andrea Delpozzo, Torbiato di Adro (IT); Emanuele Morelli, Linarolo (IT)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/569,325

(22) Filed: Jan. 5, 2022

(65) Prior Publication Data

US 2022/0216016 A1 Jul. 7, 2022

(30) Foreign Application Priority Data

Jan. 7, 2021 (EP) ..... 21150488

(51) Int. Cl.
*H01H 1/14* (2006.01)
*H01H 3/32* (2006.01)
*H01H 9/00* (2006.01)

(52) U.S. Cl.
CPC ..... *H01H 3/32* (2013.01); *H01H 1/14* (2013.01); *H01H 9/00* (2013.01)

(58) Field of Classification Search
CPC .. H01H 3/32; H01H 1/14; H01H 9/00; H01H 33/6606; H01H 33/66207; H01H 33/66261
USPC ..... 200/181, 400, 10; 218/136, 134, 139, 218/147
See application file for complete search history.

(56) References Cited

U.S. PATENT DOCUMENTS 3,283,101 A 11/1966 Cobine et al.
3,471,669 A 10/1969 Curtis
3,513,425 A 5/1970 Arndt
(Continued)

FOREIGN PATENT DOCUMENTS

DE 2636410 A1 2/1978
DE 69522282 T2 5/2002
(Continued)

OTHER PUBLICATIONS

Extended European Search Report for European Application No. 21150488.1, dated Jul. 6, 2021, 11 pages.
(Continued)

*Primary Examiner* — William A Bolton
(74) *Attorney, Agent, or Firm* — Armstrong Teasdale LLP

(57) ABSTRACT

A switching apparatus includes one or more electric pole units, each electric pole unit comprising a fixed contact, a movable contact, a first pole terminal, a second pole terminal, and a motion transmission arrangement to reversibly move the movable contact. The motion transmission arrangement includes a conductive motion transmission member coupled to the movable contact. The first pole terminal is in electrical connection to the fixed contact while the second pole terminal includes a first coupling region in electrical connection with a second coupling region of the conductive motion transmission member. Each electric pole unit further includes a shielding element formed by a conductive hollow body and arranged in a relative fixed position with respect to the second pole terminal and the motion transmission member. The shielding element is arranged to at least partially surround the first coupling and the second coupling region.

20 Claims, 8 Drawing Sheets

(56) References Cited

U.S. PATENT DOCUMENTS

| | | | | |
|---|---|---|---|---|
| 3,522,404 | A | 8/1970 | Trayer | |
| 3,670,123 | A | 6/1972 | Luehring | |
| 3,891,896 | A | 6/1975 | Clason | |
| 3,969,598 | A | 7/1976 | Sofianek et al. | |
| 4,187,437 | A | 2/1980 | Muller et al. | |
| 4,234,757 | A | 11/1980 | Simons | |
| 7,135,652 | B2 * | 11/2006 | Kobayashi | H01H 33/666 218/155 |
| 8,530,775 | B2 * | 9/2013 | Gentsch | H01H 33/66207 218/120 |
| 8,674,254 | B2 * | 3/2014 | Borgstrom | H01H 33/42 218/136 |
| 8,916,790 | B1 * | 12/2014 | Ando | H01H 33/666 218/120 |
| 10,679,807 | B2 * | 6/2020 | Meley | H01H 9/02 |
| 10,840,043 | B2 * | 11/2020 | Delpozzo | H01H 33/66207 |
| 2001/0040146 | A1 | 11/2001 | Miyo et al. | |
| 2009/0255905 | A1 * | 10/2009 | Lee | H01H 33/6606 218/139 |
| 2020/0075276 | A1 | 3/2020 | Ivanovich et al. | |

FOREIGN PATENT DOCUMENTS

| | | | |
|---|---|---|---|
| EP | 1020970 | A1 | 7/2000 |
| EP | 1119011 | A1 | 7/2001 |
| EP | 1152444 | A1 | 11/2001 |
| EP | 1195788 | A1 | 4/2002 |
| EP | 1381064 | A1 | 1/2004 |
| FR | 903046 | A | 9/1945 |
| FR | 2215687 | A1 | 8/1974 |
| JP | 2000268685 | A | 9/2000 |
| WO | 1986000464 | A1 | 1/1986 |

OTHER PUBLICATIONS

European Search Report for European Application No. 03212620, dated Aug. 26, 2003, 3 pages.

International Search Report for International Application No. PCT/GB85/00274, dated Nov. 4, 1985, 3 pages.

E.R. Perry. "Transformer Protection with high speed fault initiating switches", Allis-Chalmers Engineering Review, vol. 30, No. 4, 1965, pp. 4-8.

* cited by examiner

SWITCHING APPARATUS FOR ELECTRIC SYSTEMS

CROSS-REFERENCE TO RELATED APPLICATIONS

This application claims priority to European Patent Application No. EP21150488.1, filed Jan. 7, 2021 and titled "A SWITCHING APPARATUS FOR ELECTRIC SYSTEMS", which is hereby incorporated by reference in its entirety.

BACKGROUND

The present disclosure relates to a switching apparatus for electric systems, which is capable of providing improved performances in terms of dielectric isolation, reliability in operation and life endurance.

Traditionally, a switching apparatus for electric systems includes a plurality of electric pole units, each including a fixed contact and a movable contact to be mutually coupled or decoupled in order to allow or block a current flowing through the electric pole unit.

The fixed contact and the movable contact of each electric pole unit are electrically connected to corresponding pole terminals couplable with the conductors of an electric line.

Each electric pole unit includes a motion transmission arrangement operatively coupled to suitable actuating means (e.g. an electric or electromagnetic actuator) to move reversibly the movable contact during the manoeuvres of the switching apparatus.

In many switching apparatuses of the state of the art, such a motion transmission arrangement includes a conductive motion transmission member, which is coupled with the movable contact and which is in electrical connection with a corresponding pole terminal in such a way to ensure a conductive path between the movable contact and such a pole terminal.

The above-mentioned motion transmission member may be in sliding contact with the corresponding pole terminal or be electrically connected to said pole terminal through suitable flexible conductors (e.g. multiple conductive braids or conductive laminas).

As is known, during operation of the switching apparatus, wear phenomena normally arise in the electric pole units at the conductive parts in relative movement, namely at the coupling regions of the above-mentioned motion transmission member and pole terminal and, possibly, at the above-mentioned flexible conductors electrically connecting said motion transmission member and pole terminal.

Normally, these wear phenomena are particularly relevant in switching apparatuses, for example contactors, which are required to carry out a large number of manoeuvres (e.g. up to a million) in their operating life.

In general, such wear phenomena may cause, for example:

- variations of the relative dielectric distances between the conductive parts;
- variations of the profile of the conductive parts (e.g. the formation of sharpened edges);
- deposition of metallic dust on internal surfaces of the electric pole unit;
- reduction of the cross-section of conductive parts.

Therefore, they may have a relevant impact on the overall dielectric isolation performances of the electric pole units. Additionally, they may be also at the origin of overheating phenomena at the conductive parts.

As a consequence of the above, time-consuming and expensive maintenance interventions on the pole units of the switching apparatus are normally required to prevent the occurrence of partial discharges or other destructive events in the electric pole units.

Additionally, a particular care is required while manufacturing and installing the switching apparatus in order not to favor, somehow, the onset of the above-mentioned wear processes at the above-mentioned conductive parts of the electric pole units.

BRIEF DESCRIPTION

The main aim of the present disclosure is to provide a switching apparatus for low-voltage or medium voltage electric systems that allows solving or mitigating the above-mentioned problems.

More in particular, it is an object of the present disclosure to provide a switching apparatus having pole units showing high performances in terms of dielectric isolation.

A further object of the present disclosure is to provide a switching apparatus showing improved performances in terms of reliability and life endurance with respect to the currently available solutions of the state of the art.

As a further object, the present disclosure is aimed at providing a switching apparatus of relatively easy transportation and installation on the field.

Still another object of the present disclosure is to provide a switching apparatus that is relatively easy and cheap to manufacture at industrial level.

In order to fulfill these aim and objects, the present disclosure provides a switching apparatus, according to the following claim 1 and the related dependent claims.

In a general definition, the switching apparatus, according to the disclosure, includes one or more electric pole units.

Each electric pole unit of the switching apparatus includes a fixed contact and a movable contact. The movable contact is reversibly movable between a first operating position, at which it is separated from the fixed contact, and a second operating position, at which it is coupled with the fixed contact.

In some embodiments, each electric pole unit of the switching apparatus includes a vacuum chamber, in which the fixed contact and the movable contact are accommodated.

Each electric pole unit of the switching apparatus includes a motion transmission arrangement adapted to transmit mechanical forces to move reversibly the movable contact between said first and second operating positions. Said motion transmission arrangement includes a conductive motion transmission member coupled to the movable contact.

Each electric pole unit of the switching apparatus includes a first pole terminal and a second pole terminal for coupling with a corresponding first line conductor and second line conductor, respectively.

The first pole terminal is in electrical connection to the fixed contact.

The second pole terminal includes a first coupling region in electrical connection with a second coupling region of the conductive motion transmission member.

According to some embodiments of the disclosure, the first coupling region of the second pole terminal and the second coupling region of the conductive motion transmission member are electrically connected one over the other by one or more flexible conductors.

Said one or more flexible conductors may include at least a flexible conductive lamina having opposite ends fixed to the first coupling region of the second pole terminal and the second coupling region of the conductive motion transmission member.

As an alternative, said one or more flexible conductors may include one or more flexible conductive braids having opposite ends fixed to the first coupling region of the second pole terminal and the second coupling region of the conductive motion transmission member.

According to some embodiments of the disclosure, the first coupling region of the second pole terminal and the second coupling region of the conductive motion transmission member have coupling surfaces in sliding contact.

In some embodiments, the switching apparatus of the disclosure includes actuating means operatively coupled to the conductive motion transmission arrangement of each electric pole unit.

According to the disclosure, each electric pole unit of the switching apparatus includes a shielding element formed by a conductive hollow body and arranged in a fixed position with respect to the second pole terminal and the motion transmission member.

The shielding element is arranged in such a way to surround, at least partially, the first coupling region of the second pole terminal and the second coupling region of the conductive motion transmission member. In this way, the first coupling region of the second pole terminal and the second coupling region of the conductive motion transmission member are positioned in an internal volume of the shielding element.

In some embodiments, the aforesaid shielding element is fixed to the second pole terminal of the electric pole unit.

According to some embodiments of the disclosure, said shielding element surrounds, at least partially, the flexible conductors electrically connecting the first coupling region of the second pole terminal and the second coupling region of the conductive motion transmission member.

In this way, said flexible conductors are located in the internal volume of said shielding element.

According to some embodiments of the disclosure, said shielding element surrounds, at least partially, the coupling surfaces of the first coupling region of the second pole terminal and of the second coupling region of the conductive motion transmission member, which are in sliding contact one over the other. In this way, said coupling surfaces are located in the internal volume of said shielding element.

In some embodiments, said shielding element has first and second holes respectively at first and second opposite sides. Said motion transmission member passes through said first and second holes and the internal volume of said electrical shield element.

In some embodiments, said shielding element has an external rounded shape.

In some embodiments, said shielding element is formed by a contoured metallic bushing.

Further characteristics and advantages of the disclosure will emerge from the description of preferred, but not exclusive embodiments of the switching apparatus, according to the disclosure, non-limiting examples of which are provided in the attached drawings.

DRAWINGS

DETAILED DESCRIPTION

Figure 1:
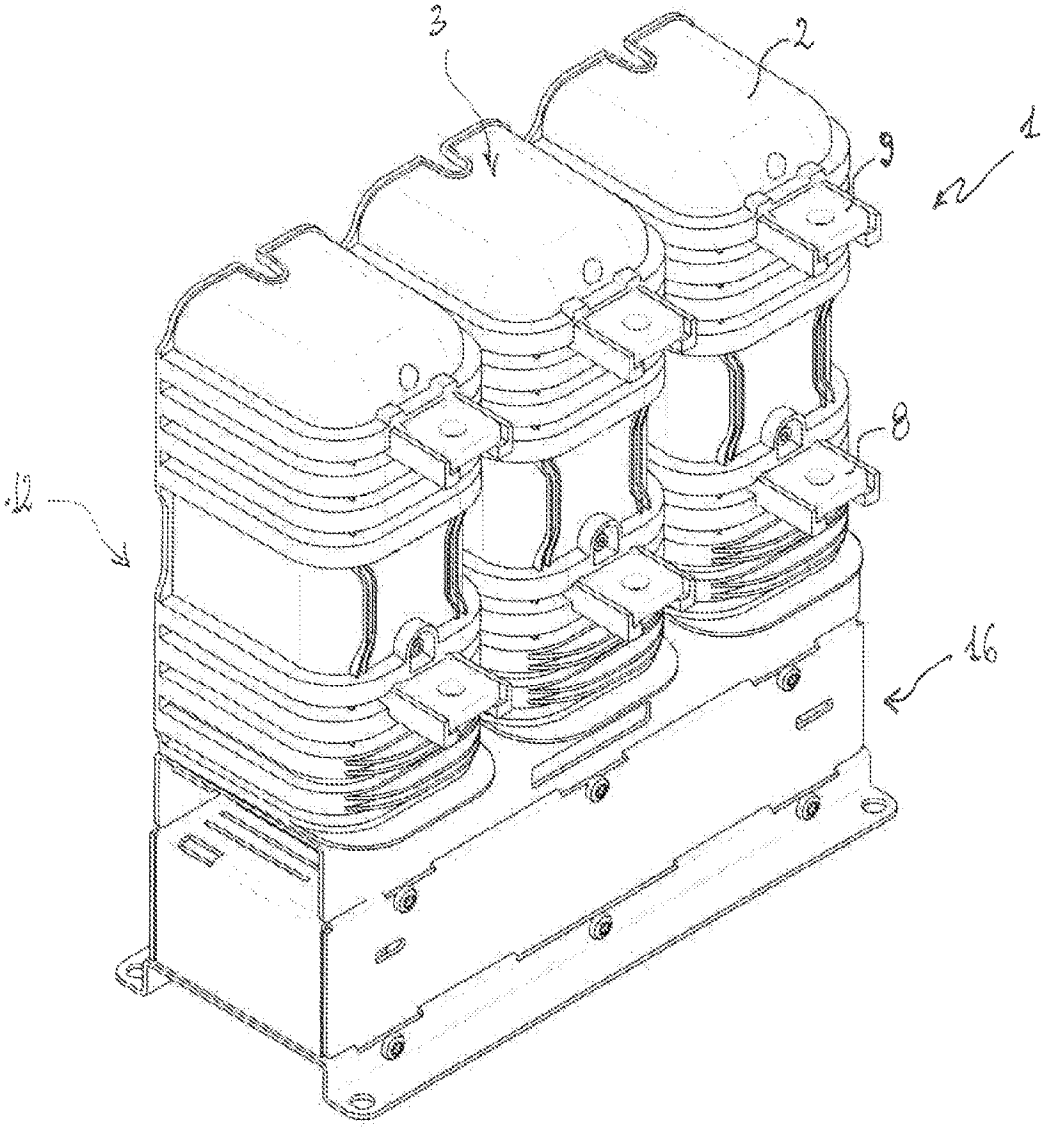
FIG. 1 is a schematic view of an embodiment of the switching apparatus, according to the disclosure.

With reference to the cited figures, the present disclosure relates to a switching apparatus 1 for low-voltage (LV) or medium voltage (MV) electric systems, e.g. electric grids, electrical switchboards, electrical switchgears, and the like.

For the purposes of the present application, the term "low-voltage" relates to operating voltages up to 1 kV AC and 1.5 kV DC whereas the term "medium voltage" relates to higher operating voltages, up to some tens of kV, e.g. up to 72 kV AC and 100 kV DC.

The switching apparatus of the disclosure may be a contactor, i.e. an apparatus designed for manoeuvring purposes, namely for breaking currents under normal circuit conditions (including overload conditions).

As an alternative, the switching apparatus of the disclosure may be a circuit breaker, i.e. an apparatus designed for protection purposes, namely for breaking currents under abnormal circuit conditions, e.g. under short-circuit conditions.

For the sake of simplicity only, the cited figures refer to embodiments of the disclosure, in which the switching apparatus 1 is a contactor designed to operate at MV levels. This choice is not intended to limit in any way the scope and purposes of the present disclosure. As a matter of fact, the switching apparatus of the disclosure may be of different type, for example a LV or MV circuit breaker, or a LV contactor, or a switching apparatus of yet a different type (e.g. a circuit breaker-disconnector) that can be used in LV or MV electric grids.

According to the disclosure, the switching apparatus 1 includes one or more electric pole units 3, namely an electric pole unit for each electric phase.

In some embodiments, the switching apparatus 1 is of the multi-phase type, more particularly of the three-phase type, as shown in the cited figures.

As shown in the cited figures, the electric pole units 3 of the switching apparatus, in some embodiments, are overlapped to a lower actuation section 16 of the switching apparatus (reference is made to a normal installation position of the switching apparatus).

In some embodiments, each electric pole unit 3 includes a housing 2 made of electrically insulating material (which may be of known type).

In some embodiments, the insulating housing 2 of each electric pole unit defines an internal volume, in which the components of the corresponding electric pole unit are accommodated.

In some embodiments, the electric pole units 3 have their insulating housing 2 formed by an elongated body of electrically insulating material, which extends along a main longitudinal axis and has a lower end, which is fixed to the actuation section of the switching apparatus, and an opposite free upper end.

Figure 5:
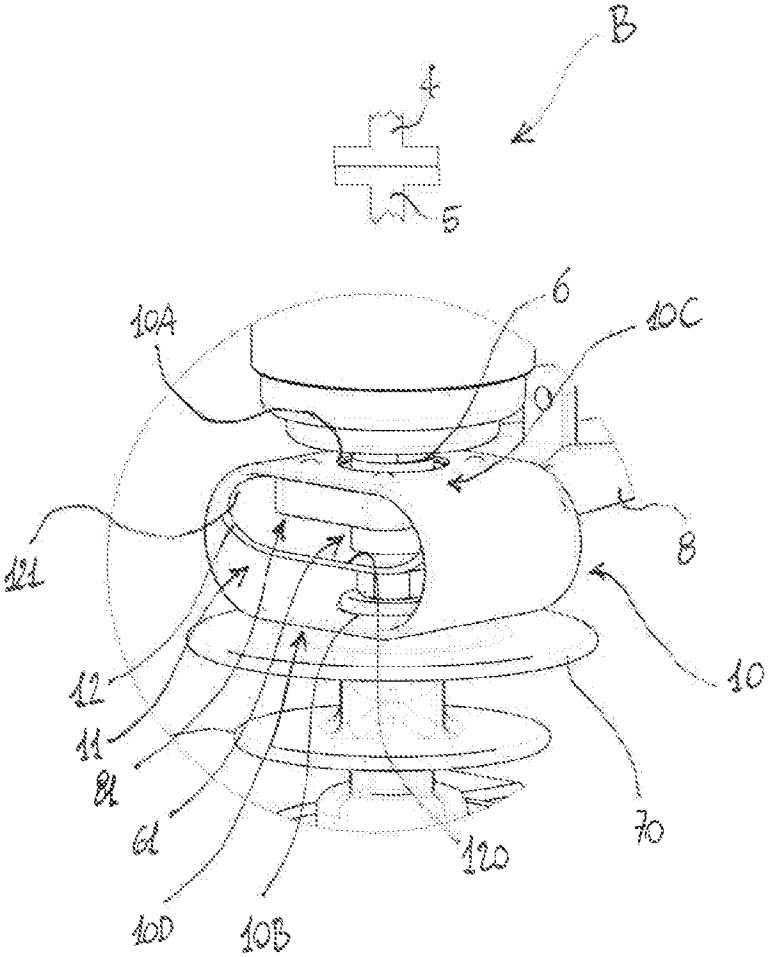
Figure 6:
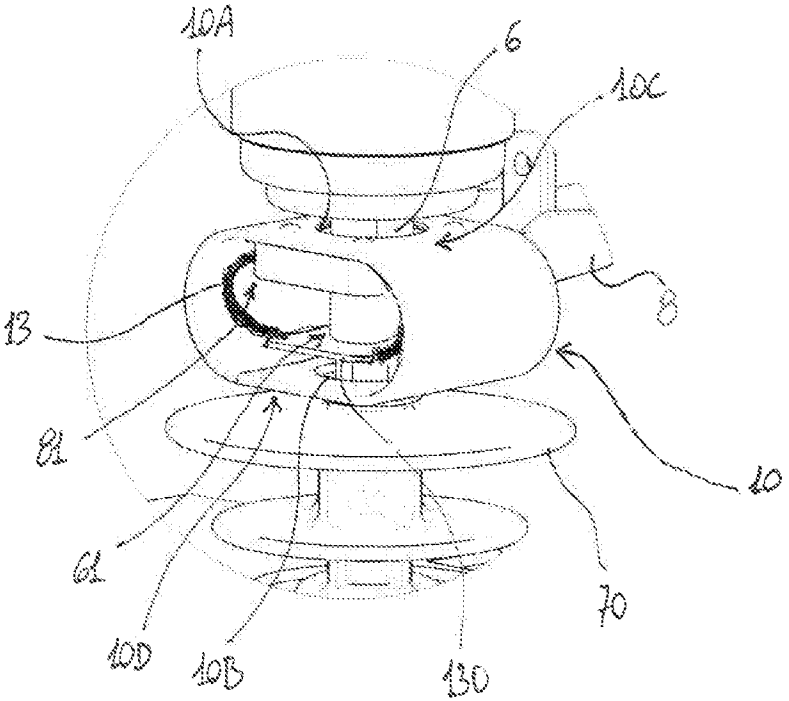
FIG. 6 is a schematic view of a part of electric pole unit of the switching apparatus of the disclosure, according to an alternative embodiment.

According to the disclosure, each electric pole unit 3 includes a fixed contact 4 and a movable contact 5, which is reversibly movable between a first operating position A (opening position—FIG. 2), at which it is separated from the corresponding fixed contact 5, and a second operating position B (closing position—FIG. 3), at which it is mechanically and electrically coupled with the corresponding fixed contact 5 (FIGS. 5-6).

The passage of the movable contacts 5 of the switching apparatus from the first operating position A to the second operating position B is a closing manoeuvre of the switching apparatus whereas the passage of the movable contacts 5 from the second operating position B to the first operating position A is an opening manoeuvre of the switching apparatus.

In some embodiments, during a manoeuvre of the switching apparatus, each movable contact 5 moves linearly (towards or away from the corresponding fixed contacts 4) along a displacement axis along the main longitudinal axis of the corresponding electric pole unit 3.

According to some embodiments of the disclosure (shown in the cited figures), each electric pole unit 3 includes a vacuum chamber 15 accommodating the fixed contact 4 and the movable contact 5 of said electric pole unit.

According to other solutions of known type, however, each electric pole unit 3 may include a breaking section, which is not segregated from the remaining internal volume of the electric pole unit. In this case, the internal volume of each electric pole unit 3 may be filled with a suitable insulating gas (e.g. $SF_6$) or air.

According to the disclosure, each electric pole unit 3 includes a motion transmission arrangement adapted to transmit mechanical forces to move reversibly the corresponding movable contact 5 between the above-mentioned first and second operating positions A, B. Such a motion transmission arrangement conveniently includes a conductive motion transmission member 6 operatively coupled to the corresponding movable contact 5 in such a way to be electrically and mechanically connected with this latter.

In some embodiments, the motion transmission member 6 is formed by a plunger of electrically conductive material, which has an end solidly coupled (e.g. screwed) with the corresponding movable contact 5 and an opposite end solidly coupled with a further plunger made of electrically insulating material.

In some embodiments, during a manoeuvre of the switching apparatus, the motion transmission member 6 moves linearly (towards or away from the fixed contact 4) along the displacement axis of the corresponding movable contact 5.

Figure 1A:
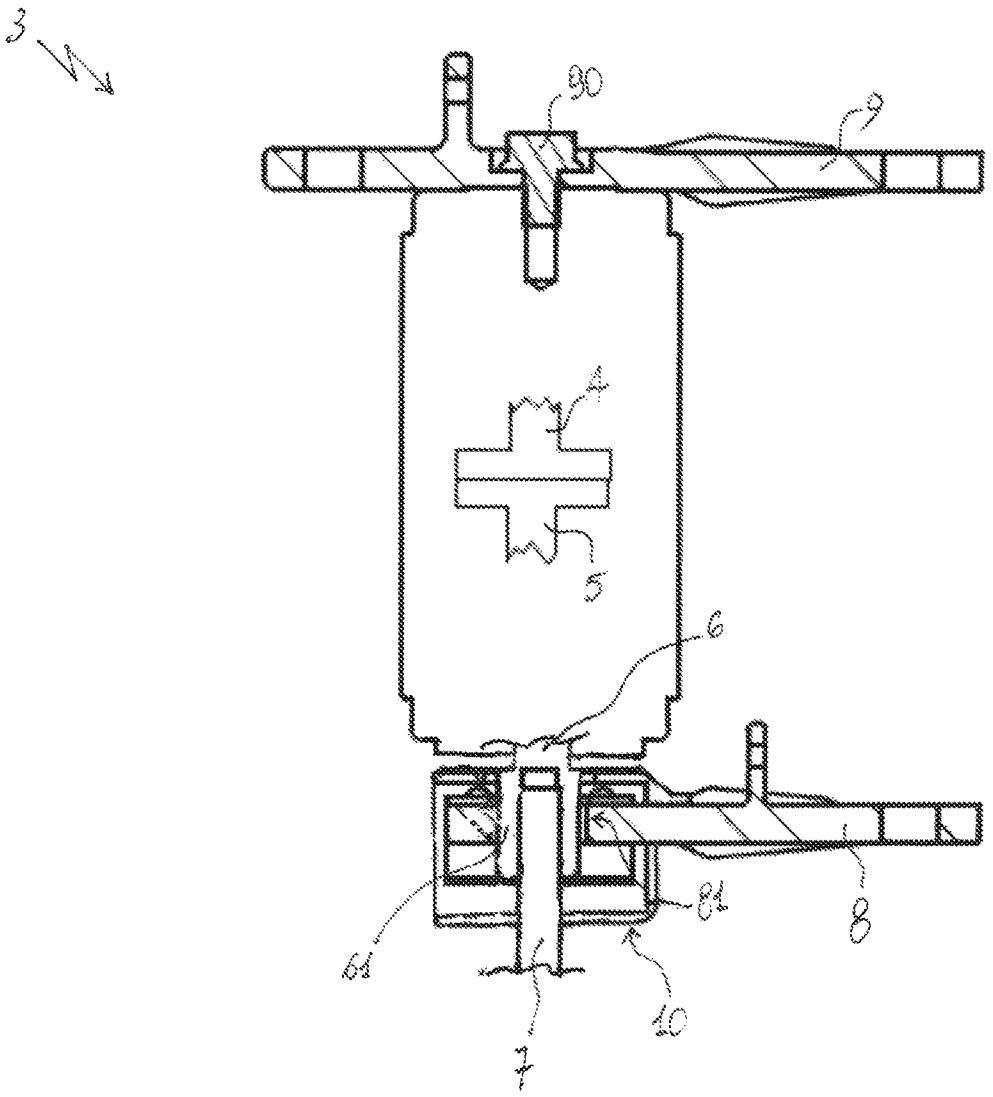
FIG. 1A is a section view schematically showing an electric pole unit of the switching apparatus of FIG. 1.

In some embodiments (FIG. 1A), the above-mentioned motion transmission arrangement includes a further motion transmission element 7 made of electrically insulating material (e.g. a thermoplastic material or a thermosetting material, and the like).

In some embodiments, the motion transmission member 7 is made of electrically insulating material solidly coupled with an end of the conductive plunger forming the motion transmission member 6.

In some embodiments, during a manoeuvre of the switching apparatus, the motion transmission member 7 moves linearly (towards or away from the fixed contact 4) along the displacement axis of the corresponding movable contact 5.

Figure 2:
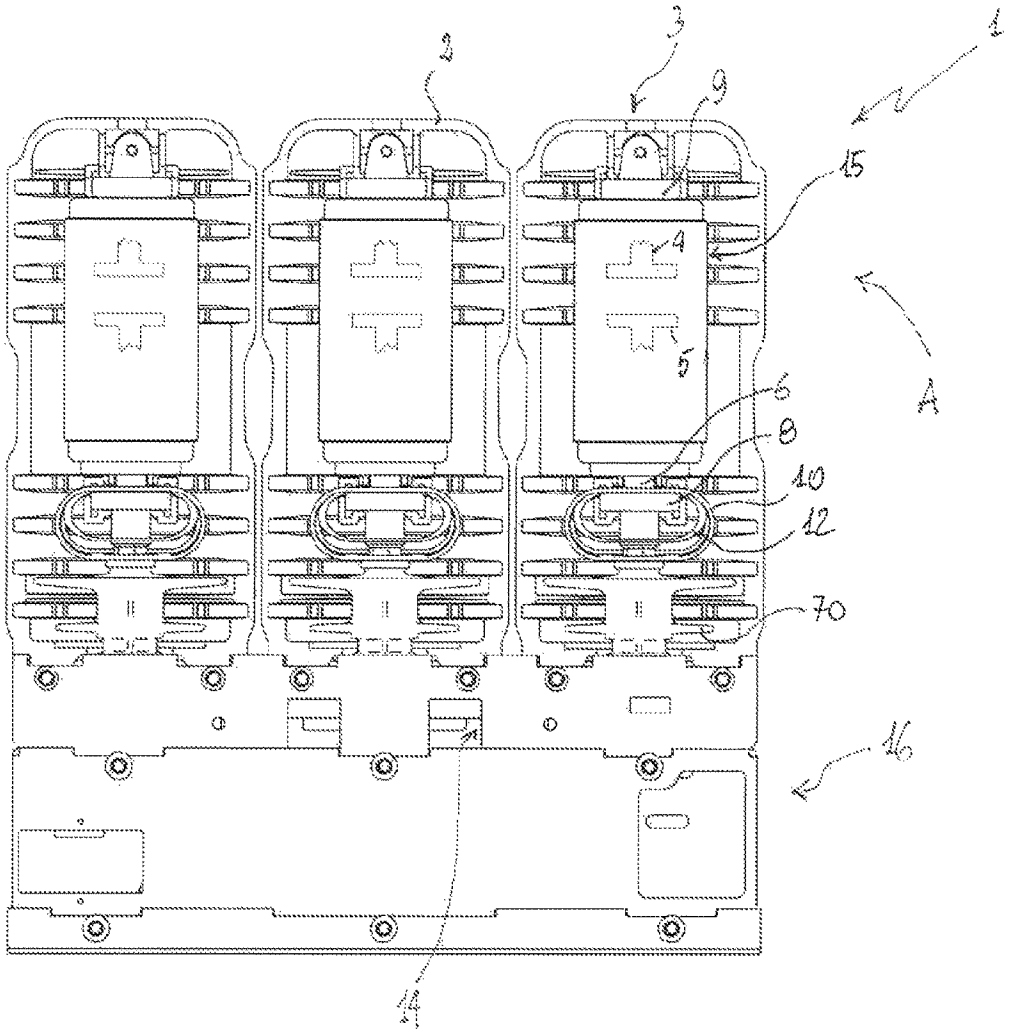
FIGS. 2-3 are section views schematically showing the switching apparatus of FIG. 1, in different operating positions.
Figure 3:
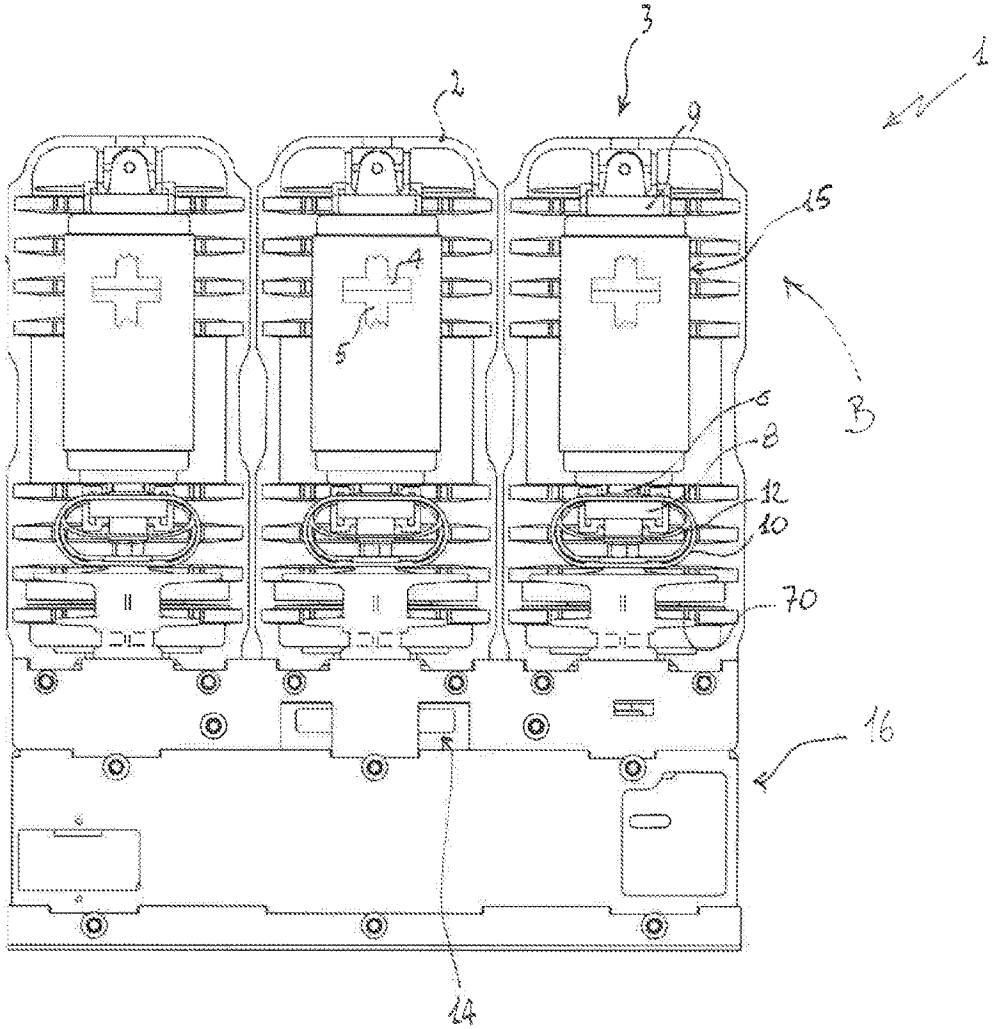

In some embodiments, the motion transmission member 7 is arranged coaxially with a bushing insulator 70 of known type (FIGS. 2-3).

Conveniently, the motion transmission member 7 of each electric pole unit is operatively coupled with actuating means 14 of the movable contacts 5 through a suitable kinematic chain (not shown).

In some embodiments, the switching apparatus 1 has the actuating means 14 operatively coupled to the motion transmission arrangement 6, 7 of each electric pole unit 3 in order to move the movable contacts 5 during the manoeuvres of the switching apparatus.

Conveniently, the actuating means 14 are accommodated in the actuation section 16 of the switching apparatus.

The actuating means 14 may include one or more actuators, for example a single actuator for the whole switching apparatus or an actuator for each electric pole unit. Such actuators may include, for example, by electric motors or electromagnetic actuators.

According to the disclosure, each electric pole unit 3 includes a first pole terminal 9 for coupling with a corresponding first line conductor and a second pole terminal 8 for coupling with a second line conductor.

In some embodiments, each pole terminal 9, 8 is formed by an electrically conductive body shaped as an elongated plate having rounded edges.

In some embodiments, each pole terminal 9, 8 is arranged at a corresponding port of the insulating housing 2 of the electric pole unit in such a way to protrude externally from this latter.

The pole terminals 9, 8 may be co-molded with the insulating housing 2 or mechanically connected (e.g. screwed) to the insulating housing 2.

The first and second pole terminals 9, 8 of each electric pole unit are electrically connected with the corresponding fixed contact 4 and movable contact 5 of the electric pole unit, respectively.

In some embodiments, the first pole terminal 9 is in electrical connection with a conductive assembly 90, which is in turn coupled to the fixed contact 4 to support this latter. In this way, a conductive path is ensured between the pole terminal 9 and the fixed contact 4.

Conveniently, the first pole terminal 9 includes a suitable coupling region, at which it is fixed (e.g. screwed) to the conductive assembly 90, which is in turn fixed (e.g. screwed) to the fixed contact 4.

The second pole terminal 8 is in electrical connection with the conductive motion transmission member 6, which is in turn coupled to the movable contact 5. In this way, a conductive path is ensured between the second pole terminal 8 and the movable contact 5.

In particular, the second pole terminal 8 includes a first coupling region 81 electrically connected to a second coupling region 61 of the conductive motion transmission member 6.

In some embodiments, at the first coupling region 81, the second pole terminal 8 includes a through hole 82 for the passage of the conductive motion transmission member 6.

According to some embodiments of the disclosure (FIGS. 4-6), the first coupling region 81 of the second pole terminal 8 and the second coupling region 61 of the conductive motion transmission member 6 are electrically connected by one or more flexible conductors 12, 13.

Figure 4:
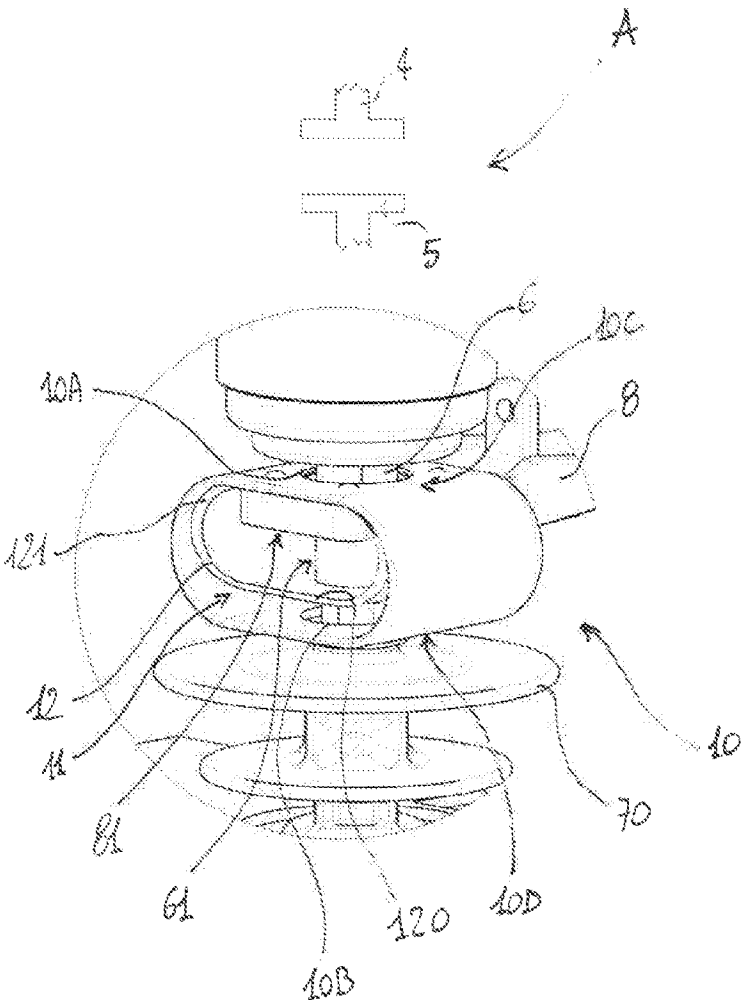
FIG. 4-5 are schematic views of a part of electric pole unit of the switching apparatus of FIG. 1, in different operating positions.

In the embodiment of FIGS. 4-5, the first coupling region 81 of the second pole terminal 8 and the second coupling region 61 of the conductive motion transmission member 6 are electrically connected by means of a flexible conductive lamina 12 (e.g. made of copper).

The conductive lamina 12 includes a holed central portion 120 fixed in known manner to the motion transmission member 6, at the second coupling region 61 of this latter. Conveniently, the motion transmission member 6 passes through the holed central portion 120.

The flexible lamina 12 has opposite ends 121 that are bent with respect to the central holed portion 120 and fixed in known manner to the first coupling region 81 of the second pole terminal 8.

Since it is fixed to the motion transmission member 6, which is movable, and to the second pole terminal 8, which is instead in a fixed position, the flexible lamina 12 is subject to deformations when the movable contact 5 moves during a manoeuvre of the switching apparatus.

In particular, as it is evident from FIGS. 4-5, the flexible lamina 12 is compressed when the movable contact 5 moves from the first operating position A to the second operating position B (opening manoeuvre) and it is subject to a relaxation when the movable contact 5 carries out an opposite movement (closing manoeuvre).

In some embodiments, as shown in the cited figures, the flexible lamina 12 is arranged in a distal position from the movable contact 5 with respect to the second pole terminal 8. In this case, it has its opposite ends 121 bent upwards (i.e. in direction of the movable contact 5) with respect to the holed central portion 120. This solution is quite convenient as it allows reducing the overall vertical size of the corresponding electric pole unit.

In principle, however, the flexible lamina 12 might be arranged at the opposite side of the second pole terminal 8, along the main longitudinal axis of the corresponding electric pole unit. In this case, the conductive lamina 12 would be bent in an opposite direction.

In the embodiment of FIG. 6, the first coupling region 81 of the second pole terminal 8 and the second coupling region 61 of the conductive motion transmission member 6 are electrically connected by means of conductive braids 13 (e.g. made of copper).

Each conductive braid 13 has an end fixed (e.g. riveted) to a conductive support element 30, which is in turn fixed to the motion transmission member 6, at the second coupling region 61 of this latter, and an opposite end fixed (e.g. riveted) to the first coupling region 81 of the second pole terminal 8.

As for the above-illustrated embodiment of the disclosure, the flexible braids 13 are subject to deformations when the movable contact 5 moves during a manoeuvre of the switching apparatus.

Also, similarly to the above, the conductive braids 13 are arranged in a distal position from the movable contact 5 with respect to the second pole terminal 8.

In principle, however, they might be arranged at the opposite side of the second pole terminal 8, along the main longitudinal axis of the corresponding electric pole unit.

Figure 7:
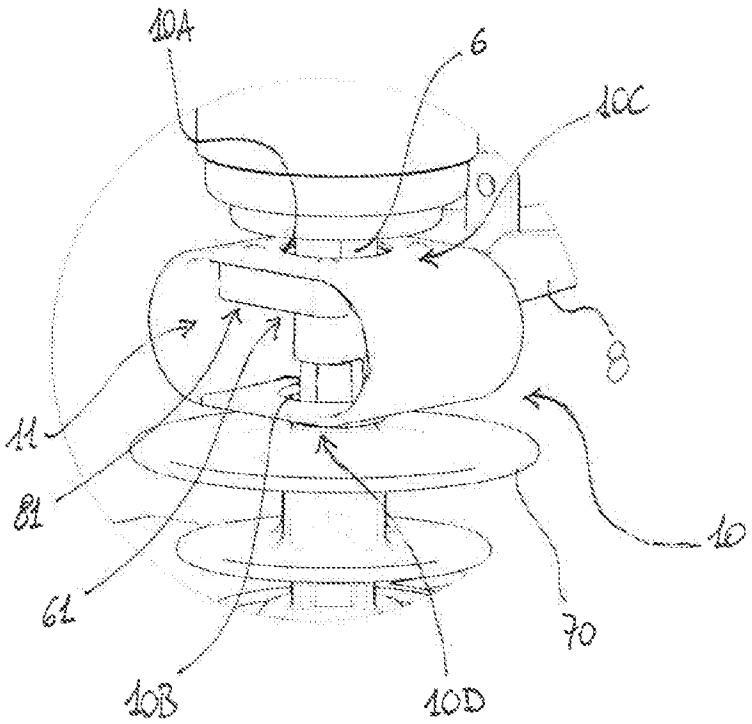
FIG. 7 is a schematic view of a part of electric pole unit of the switching apparatus of the disclosure, according to an alternative embodiment.

In the embodiment of FIG. 7, the first coupling region 81 of the second pole terminal 8 and the second coupling region 61 of the conductive motion transmission member 6 are electrically connected by means of a sliding contact arrangement.

In particular, the first coupling region 81 of the second pole terminal 8 and the second coupling region 61 of the conductive motion transmission member 6 have coupling surfaces (not shown) in sliding contact one over the other. In this way, no additional conductors have to be used to connect electrically the motion transmission element 6 and the second pole terminal 8.

In general, most of the components of the pole units 3, such as the insulating housing 2, the electric contacts 4-5, the pole terminals 8-9, the motion transmission arrangement 6, 7 and the above-mentioned coupling arrangements between the mobile contact 5 and the second pole terminal 8, may be realized at industrial level according to solutions of known type. Therefore, in the following, they will be described in relation to the aspects of interest of the disclosure only, for the sake of brevity.

According to the disclosure, electric pole unit 3 includes a shielding element 10, which is arranged in a fixed position with respect to the second pole terminal 8 and the motion transmission member.

The shielding element 10 is formed by a conductive hollow body (e.g. made of steel).

In some embodiments, as shown in the cited figures, such a conductive hollow body have a solid structure.

According to alternative embodiments of the disclosure, however, such a conductive hollow body may have a meshed structure.

The shielding element 10 is arranged in a fixed position with respect to the motion transmission member 6 and the second pole terminal 8 in such a way that it surrounds at least partially, the first coupling region 81 of the second pole terminal 8 and the second coupling region 61 of the conductive motion transmission member 6.

In this way, the first coupling region 81 of the second pole terminal 8 and the second coupling region 61 of the conductive motion transmission member 6 are located in an internal volume 11 of the shielding element, which is defined by its hollow conductive body.

In the embodiments of the disclosure shown in FIGS. 4-6, the shielding element 10 is designed in such a way to surround, at least partially, the flexible conductors 12, 13 electrically connecting the first coupling region 81 of the second pole terminal 8 and the second coupling region 61 of the conductive motion transmission member 6. Conveniently, said flexible conductors are accommodated in the internal volume 11 of the shielding element 10.

In the embodiment of the disclosure shown in FIG. 7, the shielding element 10 is designed in such a way to surround, at least partially, the coupling surfaces of the first coupling region 81 of the second pole terminal 8 and the second coupling region 61 of the conductive motion transmission member 6, which are in sliding contact one over the other. Conveniently, said coupling surfaces are accommodated in the internal volume 11 of the shielding element 10.

In some embodiments, as shown in the cited figures, the shielding element is fixed (e.g. riveted) to the second pole terminal 8, conveniently at the first coupling portion 81 of this latter.

In some embodiments, the shielding element 10 includes opposite first and second sides 10C, 10D respectively positioned in proximal position and in distal position with respect to the fixed contact 4 of the corresponding electric pole unit.

In some embodiments, the shielding element 10 is fixed to the to the second pole terminal 8 at its first side 10C in such a way that the first coupling region 81 of the second pole terminal is enclosed in the internal volume 11 of the shielding element.

In some embodiments, at the above-mentioned first and second sides 10C-10D, the shielding element 10 includes first and second holes 10A, 10B that are coaxial with the displacement axis of motion transmission member 6 and with the hole 82 of the second pole terminal 8. In this way, the motion transmission member 6 can pass through said first and second holes 10A, 10B and the internal volume 11 of the electrical shield element.

The above-illustrated arrangement remarkably simplifies the structural integration of the shielding element 10 with the motion transmission member 6 and second pole terminal 8, thereby reducing the overall size.

In some embodiments, the shielding element 10 has an external rounded shape. This solution allows equalising the electric fields external to the shielding element itself (which arise during operation of the switching apparatus) and it favours a suitable design of the dielectric distances between the conductive parts of the electric pole unit in proximity of the shielding element 10.

In some embodiments, the hollow body of the shielding element 10 has a tubular shape with an elliptical cross-section and it is positioned in such a way to have its main longitudinal axis perpendicular to the main longitudinal axis of the electric pole unit 3 and lying on a plane parallel to the lying planes of the pole terminals 8, 9.

Thanks to this arrangement, the first coupling region 81 of the second pole terminal 8 and the second coupling region 61 can be easily enclosed in the internal volume 11 of the shielding element 10. Additionally, such an arrangement simplifies the coupling of the shielding element 10 to the second pole terminal 8.

In some embodiments, the shielding element 10 is formed by a contoured metallic bushing (e.g. made of steel).

The adoption of the above-mentioned shielding element 10 provides remarkable advantages.

During the operation of the switching apparatus, the shielding element 10 conveniently operates as a Faraday cage for the conductive parts enclosed in its internal volume. The electric fields in the internal volume 11 of the shielding element 10 are therefore virtually null. In this way, possible defects at the first coupling region 81 of the second pole terminal 8 and/or at the second coupling region 61 of the conductive motion transmission member 6, which might be caused by wear phenomena arising during the operating life of the switching apparatus, do not have any substantial influence on the overall dielectric isolation capabilities of the electric pole unit 3.

The arising of dielectric hot-spots at the first coupling region 81 of the second pole terminal 8 and/or at the second coupling region 61 of the conductive motion transmission member 6, which are mostly subject to the above-mentioned wear phenomena by construction, is in fact prevented as these conductive parts are not subject to dielectric stresses.

Since it is arranged in fixed position with respect to the motion transmission member 6 and the second pole terminal 8, the shielding element 10 allows designing more accurately the dielectric distances between said conductive parts at the internal volume region of the electric pole unit 3.

Additionally, since it encloses the conductive parts in relative movement one over the other, the shielding element 10 prevents or reduces the deposition of metallic dust on internal insulating parts of the electric pole unit 3, for example on the bushing insulator 70. This allows further improving the dielectric isolation capabilities of the electric pole unit 3.

The above-mentioned advantages allow achieving a remarkable improvement of the internal dielectric isolation performances of the electric pole units with respect to the traditional solutions of the state of the art. Laboratory tests have shown an increase up to 300% of the inception voltage of partial discharges in the internal volume of the electric pole units with respect to electric pole units having a similar operating history.

The shielding element 10 intrinsically makes more robust the electrical connection between the first coupling region 81 of the second pole terminal 8 and the second coupling region 61, thereby providing a protection from possible damages that may be caused during the transportation and the installation the switching apparatus.

The shielding element 10 allows improving thermal dissipation in the internal volume of the electric pole unit 3. Being arranged along the conductive path between the movable contact 5 and the second pole terminal 8, it can effectively dissipate heat generated by the current flowing along the electric pole unit, since it may act as a heat dissipating fin.

The switching apparatus 1 of the disclosure may be subject to modifications and variants falling within the scope of the present disclosure.

In principle, the shielding element 10 may be differently arranged with respect to the embodiments of the disclosure shown in the cited figures.

According to some embodiments of the disclosure, the shielding element 10 may be formed by a substantially closed hollow enclosure, e.g. having a cylindrical, spherical or ellipsoidal shape, and possibly provide with shaped windows to allow its structural integration with the motion transmission member 6 and the second pole terminal 8.

According to some embodiments of the disclosure, the hollow conductive body of shielding element 10 may be formed be formed by a relatively rigid mesh or cage of metallic material, which may be suitably shaped in such a way to define an internal volume in which the first coupling region 81 of the second pole terminal 8 and the second coupling region 61 of the conductive motion transmission member 6 may be accommodated.

The switching apparatus 1, according to the disclosure, provides remarkable advantages with respect to the known apparatuses of the state of the art.

The switching apparatus of the disclosure has electric pole units provided with shielding elements capable of preventing a possible decay of the dielectric isolation capabilities, which may be due to the effects of wear phenomena one conductive parts in relative movement.

In this way, the electric pole units can show high performances in terms of dielectric isolation.

The switching apparatus of the disclosure therefore shows high levels of reliability and an improved life endurance with respect to the currently available solutions of the state of the art.

The switching apparatus of the disclosure has electric pole units with a robust structure, in particular for what concerns their conductive parts in relative movement one over the other.

The switching apparatus of the disclosure is therefore relatively easy to transport and install on the field with respect to the currently available solutions of the state of the art.

The switching apparatus of the disclosure can be easily manufactured at industrial level, at competitive costs with respect to the solutions of the state of the art.

The invention claimed is:

1. A switching apparatus for electric systems, said switching apparatus having one or more electric pole units, each electric pole unit comprising:

a fixed contact and a movable contact, said movable contact being reversibly movable between a first operating position, at which said movable contact is separated from said fixed contact, and a second operating position, at which said movable contact is coupled to said fixed contact;

a motion transmission arrangement adapted to transmit mechanical forces to move reversibly said movable contact between said first and second operating positions, said motion transmission arrangement including a conductive motion transmission member coupled to said movable contact;

a first pole terminal for coupling with a corresponding first line conductor, said first pole terminal being in electrical connection to said fixed contact; and a second pole terminal for coupling with a corresponding second line conductor, said second pole terminal being in electrical connection with said conductive motion transmission member, wherein each electric pole unit comprises a shielding element formed by a conductive hollow body, said shielding element being arranged in a fixed position with respect to said second pole terminal and said conductive motion transmission member, said shielding element surrounding, at least partially, a first coupling region of said second pole terminal and a second coupling region of said conductive motion transmission member in electrical connection with said first coupling region, such that said first and second coupling regions are located in an internal volume of said shielding element, and wherein said first coupling region of said second pole terminal and said second coupling region of said conductive motion transmission member are electrically connected to one another by one or more flexible conductors, said shielding element surrounding, at least partially, said one or more flexible conductors, such that said one or more flexible conductors are located in the internal volume of said shielding element.

2. The switching apparatus according to claim 1, wherein said shielding element is fixed to said second pole terminal.

3. The switching apparatus according to claim 1, wherein said shielding element has an external rounded shape.

4. The switching apparatus according to claim 1, wherein said shielding element is formed by a metallic bushing.

5. The switching apparatus according to claim 1, wherein said shielding element has first and second holes respectively at first and second opposite sides, said conductive motion transmission member passing through said first and second holes and the internal volume of said shielding element.

6. The switching apparatus according to claim 1, wherein said one or more flexible conductors include a flexible conductive lamina having opposite ends fixed to said first coupling region of said second pole terminal and said second coupling region of said conductive motion transmission member, respectively.

7. The switching apparatus according to claim 6, wherein said flexible conductive lamina comprises copper.

8. The switching apparatus according to claim 6, wherein said flexible conductive lamina is arranged in a distal position from said movable contact with respect to said second pole terminal.

9. The switching apparatus according to claim 6, wherein said opposite ends of said flexible conductive lamina are bent in a direction of said movable contact.

10. The switching apparatus according to claim 1, wherein said one or more flexible conductors include one or more flexible conductive braids having opposite ends fixed to said first coupling region of said second pole terminal and said second coupling region of said conductive motion transmission member, respectively.

11. The switching apparatus according to claim 10, wherein said one or more flexible conductive braids comprise copper.

12. The switching apparatus according to claim 10, wherein said one or more flexible conductive braids are arranged in a distal position from said movable contact with respect to said second pole terminal.

13. The switching apparatus according to claim 10, wherein said opposite ends of said one or more flexible conductive braids are riveted to said first coupling region of said second pole terminal and said second coupling region of said conductive motion transmission member, respectively.

14. The switching apparatus according to claim 1, further comprising an actuating means operatively coupled to said motion transmission arrangement of each electric pole unit.

15. The switching apparatus according to claim 1, wherein each electric pole unit comprises a vacuum chamber, in which said fixed contact and said movable contact of said electric pole unit are accommodated.

16. The switching apparatus according to claim 1, further comprising a contactor configured to operate at medium voltage levels.

17. The switching apparatus according to claim 1, further comprising a contactor configured to operate at low voltage levels.

18. The switching apparatus according to claim 1, wherein said shielding element is riveted to said second pole terminal.

19. The switching apparatus according to claim 1, wherein said second coupling region of said conductive motion transmission member couples said conductive motion transmission member with a further motion transmission member.

20. The switching apparatus according to claim 19, wherein said further motion transmission member comprises an electrically insulating material.

* * * * *